United States Patent [19]

Barlow

[11] 4,434,893

[45] Mar. 6, 1984

[54] TAMPER EVIDENT PACKAGING

[75] Inventor: Gordon A. Barlow, Glenview, Ill.

[73] Assignee: Gordon Barlow Design, Skokie, Ill.

[21] Appl. No.: 457,938

[22] Filed: Jan. 14, 1983

[51] Int. Cl.[3] ..... B65D 81/20; B65D 77/04

[52] U.S. Cl. ..... 206/522; 206/807; 206/532; 383/3

[58] Field of Search ..... 206/522, 807, 532; 5/441, 442, 449; 229/62.5; 150/9; 383/3, 38, 904

[56] References Cited

U.S. PATENT DOCUMENTS

| | | | |
|---|---|---|---|
| 3,949,879 | 4/1976 | Peterson et al. | 206/522 |
| 4,155,453 | 5/1979 | Ono | 206/522 |
| 4,169,531 | 10/1979 | Wood | 206/532 |
| 4,240,556 | 12/1980 | Field | 229/62.5 |

FOREIGN PATENT DOCUMENTS

| | | | |
|---|---|---|---|
| 2320243 | 4/1977 | France | 206/522 |

*Primary Examiner*—William T. Dixson, Jr.
*Assistant Examiner*—Brenda J. Ehrhardt
*Attorney, Agent, or Firm*—Kinzer, Plyer, Dorn & McEachran

[57] ABSTRACT

A tamper evident packaging for contaminatable products. The packaging includes inner and outer gas-tight containers. In one embodiment, the inner container has only one flexible wall and the outer container has only one flexible wall. The inner and outer containers are each pressurized with gas above atmospheric pressure to inflate their flexible walls. In another embodiment of the invention, both walls of each of the inner and outer containers are flexible. The capsules, pill and the like to be protected are located inside the inner container and the inner container is positioned inside the outer container providing a package which is difficult to tamper with and will clearly show evident of tampering both through appearance and characteristic feel to the would be purchaser.

8 Claims, 2 Drawing Figures

Fig. 1.
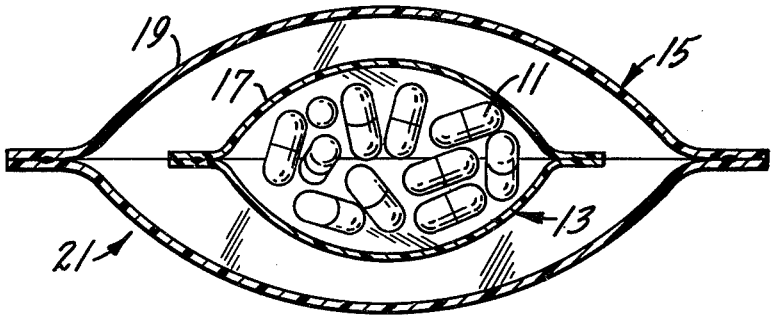
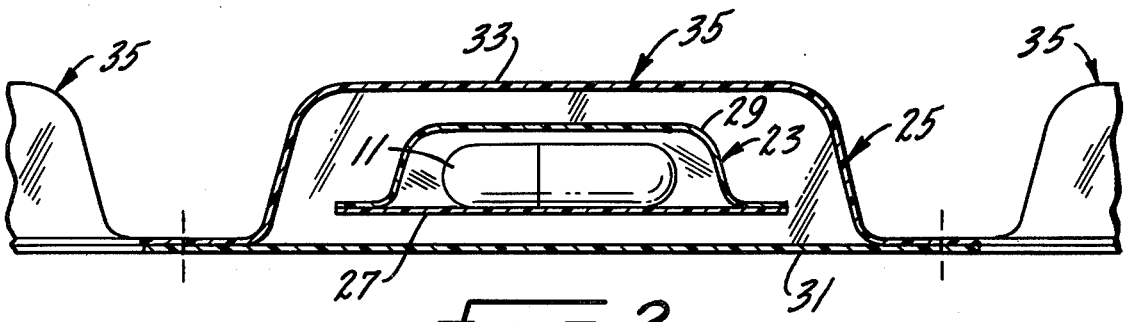
Fig. 2.

TAMPER EVIDENT PACKAGING

BACKGROUND AND SUMMARY OF THE INVENTION

This invention is directed to a tamper evident packaging for substances such as capsules, pills and other products which can be contaminated or tampered with. The recent highly publicized incidents of contamination of non-prescription drugs in capsules has created a demand for tamper evident packaging for these and other such products. Many conventional methods of sealing containers for capsules, pills and the like will indicate the most blatant types of tampering but will not indicate if more sophisticated methods of tampering like the use of a small hypodermic needle is employed.

Thus, an object of this invention is a packaging for such products which will clearly and quickly indicate intrusion into the packaging even by as small an object as a very fine hypodermic needle.

Another object of this invention is a tamper evident packaging for capsules, pills and the like which are relatively simple and inexpensive to manufacture.

Another object of this invention is a package which will indicate by touch whether or not it has been tampered with.

Other objects and advantages of the invention will be found in the following specification, claims and drawings.

BRIEF DESCRIPTION OF THE DRAWINGS

FIG. 1 is a cross-sectional view of one embodiment of the tamper evident packaging of this invention; and FIG. 2 is a cross-sectional view similar to FIG. 1 of another embodiment of tamper evident packaging of this invention.

DESCRIPTION OF THE PREFERRED EMBODIMENT

FIG. 1 of the drawing shows one embodiment of the packaging of the invention. In this embodiment, the capsules 11 are sealed in a flexible container 13 and the flexible container 13 is sealed inside an outer flexible container 15. The inner container 13 is formed of two sheets 17 of gas-tight, flexible film of any suitable type but preferably a film that is transparent. The sheets are sealed to each other about their edges to form the gas-tight inner container. Sealing of the edges can be accomplished in any conventional manner compatible with the physical characteristics of the sheets 17 such as by the use of adhesive, heat, ultrasonic, etc. Before completely sealing the edges of the sheets 17, a gas such as air is injected into the container 13 under a pressure higher than atmospheric so that the flexible sheets 17 forming the walls of the container are inflated.

The outer container 15 is also formed of two sheets 19 of similar, gas-tight flexible material which sheets also are sealed around their peripheries to form the outer container. In the same manner as described for the first container, a gas such as air is injected into the gas-tight outer container before it is completely sealed to inflate the flexible sheets forming the walls 19 of the outer container 15.

The gas pressure in the outer container should be approximately equal to the pressure in the inner container but not so much high as would cause deformation of the inflated walls of the inner container. When the package 21, consisting of the capsules 11 inside the sealed inner container 13 and the inner container sealed in the outer container 15, is assembled, the capsules 11 are protected by inner and outer containers both of which have walls that are inflated by gas above atmospheric pressure. The integrity of this packaging is readily apparent to the purchaser so long as both of the inner and outer packages are inflated. Even the slightest tampering, for example, by the insertion of a very fine hypodermic needle, will puncture both the inner and outer containers before any of the capsules or pills can be reached. The person attempting the contamination would fine it next to impossible to repair any puncture in the inner container 13 even if it were possible to repair the outer container 15. Even the slightest puncture would release the gas pressure in the container being punctured. In addition to repairing punctures, the tamperer would also have to re-establish the proper gas pressures in both the inner and outer containers to conceal the tampering, a difficult feat to accomplish.

A would-be purchaser can also determine the integrity of the package 21 by squeezing it. When both the inner and outer containers are properly pressurized, the package will have a characteristic "puffy" feeling. If even one of the containers has been depressurized, the package will have a different feeling.

A second embodiment of the invention is shown in FIG. 2 of the drawings in which one of the walls of each of the inner and outer containers may be rigid rather than flexible thereby adapting the invention to what is commonly called a bubble packaging. In this embodiment, the capsules 11 are housed inside an inner container 23 which is housed inside an outer container 25. The inner container is made up of two walls. One wall 27 is rigid while the other wall 29 is flexible. Both of these walls are formed of gas-tight materials. The outer container 25 is constructed with one rigid wall 31 and one flexible wall 33 both of which are formed of gas-tight materials. Each of these containers is sealed around the parameters of their rigid and flexible walls in the same manner as previously described for package 21. The sealing is completed only after gas, preferably air, is introduced into each container to inflate its flexible wall and create a pressure in the container above atmospheric. The assembly of the inner and outer containers provides a package 35 in which the capsules are protected by inner and outer containers, each of which contains gas under greater than atmospheric pressure. Any tampering with the outer or inner containers would immediately release the gas pressure and make the tampering highly evident both visually and to the touch of the would be purchaser. Repairs to the inner container 23 to eliminate evidence of tampering and restore the package to its original condition would be practically impossible.

Packages 21 and 35 may be manufactured in any convenient size with each package dimensioned to house anywhere from one to many capsules or pills. Packages which house only a single capsule or pill are often integrally formed into sheets of packages with the packages being easily divisible from the sheet along perforated tear lines and the like. Packages 21 and 35 could be made into sheets of packages for single capsules or pills in this manner. These packages could also be formed separately each to house only a single capsule or pill.

I claim:

1. A tamper evident packaging for contaminateable products including:

inner and outer gas tight containers, the inner container having at least one flexible wall, the outer container having at least one flexible wall, the inner and outer containers each being pressurized with gas above atmospheric pressure to inflate their flexible walls.

2. The tamper evident packaging of claim 1 in which one wall of each of the inner and outer containers is rigid.

3. The tamper evident packaging of claim 2 in which the inner container is positioned inside the outer container so that the rigid walls are located adjacent one another.

4. The tamper evident packaging of claim 1 in which all the walls of the inner and outer containers are flexible.

5. A tamper evident packaging for capsules, pills and the like including:

a sealed inner container for receiving and enclosing the capsules, pills and the like, the inner container being constructed of gas tight material including at least one inflatable flexible portion, the sealed inner container being filled with gas at a pressure above atmospheric which is at least sufficient to inflate the flexible portion thereof, and a sealed outer container receiving and enclosing the sealed inner container, the outer container being constructed of gas tight material including at least one inflatable flexible portion, the sealed outer container being filled with gas at a pressure above atmospheric at least sufficient to inflate the flexible portion thereof but insufficient to deflate the flexible portion of the sealed inner container.

6. The tamper evident packaging of claim 5 in which the sealed inner container includes a rigid portion and the sealed outer container contains a rigid portion with both rigid portions being located adjacent each other.

7. The tamper evident packaging of claim 5 in which the entire sealed inner container is formed of an inflatable, flexible gas tight material.

8. The tamper evident packaging of claim 5 in which the sealed outer container is formed entirely of an inflatable flexible gas tight material.

* * * * *